US005973446A

United States Patent [19]

Kaftanov et al.

[11] Patent Number: 5,973,446

[45] **Date of Patent: *Oct. 26, 1999**

[54] FIELD EMISSION CATHODE AND METHODS IN THE PRODUCTION THEREOF

[75] Inventors: Vitaly Sergeevich Kaftanov; Alexander Leonidovich Suvorov; Evgenij Pavlovich Sheshin, all of Moscow, Russian Federation

[73] Assignee: Lightlab AB, Stockholm, Sweden

[ * ] Notice: This patent is subject to a terminal disclaimer.

[21] Appl. No.: 08/894,270

[22] PCT Filed: Feb. 15, 1996

[86] PCT No.: PCT/SE96/00209

§ 371 Date: Nov. 6, 1997

§ 102(e) Date: Nov. 6, 1997

[87] PCT Pub. No.: WO96/25733

PCT Pub. Date: Aug. 22, 1996

Related U.S. Application Data

[63] Continuation of application No. 08/467,825, Jun. 6, 1995, Pat. No. 5,588,893.

[51] Int. Cl.[6] ..... H01J 1/05; H01J 9/00

[52] U.S. Cl. ..... 313/310; 445/6

[58] Field of Search ..... 445/6; 313/310

[56] References Cited

U.S. PATENT DOCUMENTS

| | | | |
|---|---|---|---|
| 4,272,699 | 6/1981 | Faubel et al. . | |
| 4,728,851 | 3/1988 | Lambe . | |
| 5,588,893 | 12/1996 | Kaftanov et al. | 445/6 |

*Primary Examiner*—Sandra O'Shea
*Assistant Examiner*—Michael J. Smith
*Attorney, Agent, or Firm*—Jacobson, Price, Holman & Stern, PLLC

[57] ABSTRACT

A field emission cathode and methods for fabricating such a cathode from at least one body containing a first substance. The steps include a preparation of at least one irregularity in an emitting surface of the body, adding to the emitting surface of the body ions of a second substance with a low work function, and modifying the emitting surface by inducing field emission in applying a variable electric field to the body and increasing the field strength in steps.

21 Claims, 1 Drawing Sheet

FIELD EMISSION CATHODE AND METHODS IN THE PRODUCTION THEREOF

This application is a continuation of Ser. No. 08/467,825 filed Jun. 6, 1995, now U.S. Pat. No. 5,588,893.

FIELD OF THE INVENTION

The present invention relates to a field emission cathode to be used in light sources and similar devices, such as display panels, cathode-ray tubes, etc., and to methods in the production of such a field emission cathode.

BACKGROUND OF THE INVENTION

In order for field emission illuminating devices to become useful, there is a need for a field emission cathode with a higher efficiency than known cathodes. Once a field emission cathode is achieved with a low work function, high durability, non-polluting composition and low production cost, it will be possible to replace a great variety of light sources with light sources including a field emission means in combination with a fluorescent surface for emission of visible light.

For example, great efforts are made today for reducing problems with commonly used fluorescent tubes, which require complicated external electrical devices and contain material with negative environmental effects. In present fluorescent tubes, gas discharge is employed for emitting radiation onto a fluorescent material that emits visible light in turn. A new type of emission means is desired for eliminating drawbacks of present fluorescent tubes.

PRIOR ART

U.S. Pat. No. 4,728,851 discloses a field emission cathode in an emitting device with a memory function, consisting of one carbon fibre with a diameter in the order of two micrometers with an emitting end sharpened by corona discharge to a diameter of approximately 0.2 micrometers.

U.S. Pat. No. 4,272,699 discloses a field emission cathode in an electron impact ion source device consisting of a bundle of carbon fibres with diameters in the order of two to ten micrometers with emitting ends, which are cut off and not sharpened by any refinishing operation.

The above-mentioned documents are incorporated by reference.

SUMMARY OF THE INVENTION

An object of the invention is to provide a method in the production of a field emission cathode, wherein the cathode is provided with a surface geometry that facilitates the achievement of local high electric field strengths for electron field emission. Another object is to provide a method in the production of a field emission cathode, wherein the cathode has a high mechanical and electrical durability. Another object is to provide a method in the production of a field emission cathode, wherein the cathode has a low work function. Another object is to provide a method in the production of a field emission cathode, wnerein negative environmental effects of an illuminating device including the cathode are minimized. Another object is to provide a method in the production of a field emission cathode, wnerein the cathode has an advantageous geometrical configuration. Another object is to provide a method in the production of a field emission cathode, wherein the cathode gives a very short switching time in the electron emission.

Another object of the invention is to provide a field emission cathode for elect-on field emission with a surface geometry adapted for high intensity local electric fields. Further objects of a field emission cathode of the invention are to attain a field emission cathode with an emitting surface having irregular topography facilitating electron field emission, a high mechanical durability, a high electrical durability of cathode, preferably a low electron work function, as well as a long life in use, a high emission of energy per unit area of cathode, a very short switching time it the electron emission, and minimized negative environmental effects of an illuminating device including the cathode.

A further object of the invention is to improve an illuminating device, or other electron field emission devices, the operating principles of which are known per se, by employing at least one field emission cathode with features set fourth above.

The above objects are attained by the features set fourth in the appended claims.

In a method of the invention, a field emission cathode constituted by at least one body, preferably purified to contain essentially a first substance, and preferably normalized in its internal and surface structure, is treated in the following steps: preparing the body or bodies by mechanical, thermal, erosion, and/or irradiation treatment so as to provide it with at least one emitting surface having irregularities facilitating electron field emission; and modifying the emitting surface by applying to the body a variable electric field, in order to induce electron field emission from the emitting surface, and increasing the field intensity according to a predetermined scheme, in order to preserve the irregularities of the emitting surface, to such an extent that full operating voltage may then be applied momentarily (in a step) without any substantial deterioration of the field emitting properties of the cathode. The method may comprise the step of adding to the emitting surface a second substance with a lower work function than that of the first substance, in order to lower the electrical field strength required to induce electron field emission from the emitting surface.

One way of arriving at a suitable initial material for the cathode would be to anneal the body or the initial material, in order to remove from it other substances than the first substance and/or to normal is structure. The term normalization may be understood as reduction of the occurrence of amorphous structures of the body of the initial material.

The body of the cathode may have any geometric configuration, including but not limited to a fibre, a layer, a cone shaped body, and a block. The term irregularities should not be understood as excluding non-smooth geometries formed in a regular pattern on the emitting surface.

The preparation step may more specifically be performed through mechanical grinding, electrical spark discharge, or ion bombardment. It is preferred to perform the step of preparation by bombardment simultaneously with the step of modifying, see below. Also, in the case of preparing by ion bombardment, that step could be performed with ions of the second substance, which would combine the step of adding with the step of preparing (and modifying).

In the case of the bodies being a bundle of fibres, there will occur typically, in the step bombarding emitting ends with ions, a spreading or diverging of the emitting ends of the bundled fibre segments, said spreading being advantageous for a wider distribution of electrons in the field emission.

Preferably, the first substance of the cathodes is carbon or a substance with similar properties. The use of carbon is advantageous, e.g., due to its ability to develop irregularities when hit by ions in production and in normal use. The second substance (the implant), if used, may be cesium or other suitable material with a low work function. it would be possible to manufacture or develop a suited electro-conductive body from either a solid, liquid or gaseous phase of the selected substance(s) or through an external action on a body.

The irregularities remaining after the step of preparing the emitting ends by bombarding (irradiating) with, and possibly adding (doping), ions are crucial to field emission properties of the cathode. The irregularities may consist of peaks or tips (microtips) of carbon, which is possibly cesium-doped. The radius of curvature of the tips are preferably within the orders of magnitude of 0.1–100 nanometers. The step of modifying the emitting surface is a "burning-in" process, in which the irregularities are rounded off at the peaks by melting due to heat generation from electron field emission. According to the invention, this process is performed carefully, so that only the sharpest or highest points are rounded off, leaving irregularities that withstand momentary application of full operating voltage without melting.

Preferably, the variable voltage in the step of modifying is applied either in predetermined steps, according to a predetermined (continuous) curve, or with regulation in respect to a maximum voltage derivative with respect to time, so as to limit probability of local current density in tips (irregularities) of the ends exceeding a predetermined value (restricting or limiting points of melting). Excessive melting will result in a disadvantageous smoothing of the surface. This smoothing will be more severe should the heat not be allowed to escape from the tips through raising the field emission current (field intensity) slowly or in a number of steps the first time. One possible way of expressing a criterion for the modifying step could be limiting the probability of local current density in irregularities of the tips exceeding a predetermined value. Another would be increasing the variable electric field, in such a manner that a deterioration of said irregularities of said emitting surface is limited.

It is advantageous to perform the step of modifying the emitting surface to enhance the electrical durability of its emitting tips (irregularities) in an evacuated environment containing some residual gas (ions) which will bombard the surface as a result of the applied electrical field. The advantages of this process seem to result from continuous development of emitting tips of higher electrical and mechanical durability as the electrical field strength is increased in a controlled manner, causing electrically less durable tips to melt due to increasing current and causing mechanically less durable tips to be deformed due to increasing energy of incident ions. this process gives an emitting surface with durable emitting tips. In use of the cathode there will be a re-creation of emitting tips due to effects similar to what is described above.

Generally, the first substance of the cathode could contain a crystal or a grain structure or both. Moreover, it is possible for the irregularities to occur in the form of micro-pores or cavities with high concentration, where the first substance has a (micro-) grain structure. Alternatively, the cathode could be a flat plate structure, e.g., achieved through pornography.

The steps of preparing, adding (for example by bombarding) and modifying, respectively, may be used independently or in a different order to arrive at a field emission cathode with an improved function. It is to be understood that these steps may also be performed in various combinations, sequentially, simultaneously, or repeatedly.

More than one of the cathodes may be combined on a substrate into a compound cathode suited for the geometry of a specific illuminating device.

The invention is directed not only toward use in lamps, fluorescent tubes, cathode-ray tubes, but to any other devices it where electron field emission is desired. It would even be possible to apply the invention using only one single tip (irregularity).

DESCRIPTION OF A PREFERRED EMBODIMENT

In a preferred method of the invention, the field emission cathode is made from a fibre material containing a first substance, the method comprising firstly the steps of combining a plurality of fibres of the fibre material; cutting, mechanically or by melting, bundles from the fibre material, each bundle consisting of a plurality of fibre segments of a predetermined length; and annealing the fibre segments in order to remove from it other substances than the first substance, and/or to normalize the structure of the first substance in the fibre segments.

After the cutting and annealing, the fibre segments of the bundles each have an emitting end with inherent irregularities. The method secondly comprises the steps of irradiating the emitting ends of the fibre segments with ions, to increase and improve irregularities of the emitting ends, in order to facilitate electron field emission (Stronger local electrical fields are formed generally at irregularities or tips); and modifying the emitting ends by applying a variable voltage to the fibre segments and increasing according to a predetermined scheme the variable voltage, during electron field emission from the emitting ends, in order to preserve the irregularities of the emitting ends, to such an extent that full operating voltage may then be applied momentarily (in a step) without any substantial deterioration of the field emitting properties of the cathode. The steps of irradiating and modifying are performed simultaneously in an evacuated environment containing residual gas ions. The ion bombardment may involve adding ions of a second substance with a lower work function than that of the first substance.

Figure 1:
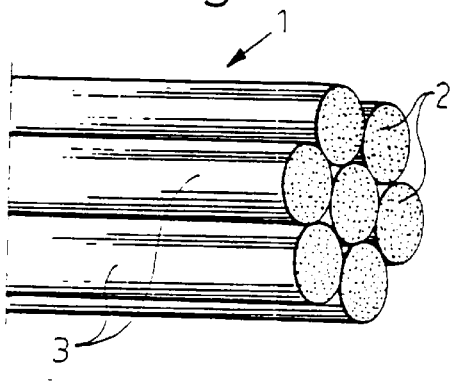
FIG. 1 shows for clarity, after a step of cutting fibres into segments and annealing the fibres, part of a bundle made of a plurality of the fibres to constitute one field emission cathode of the invention.
Figure 2:
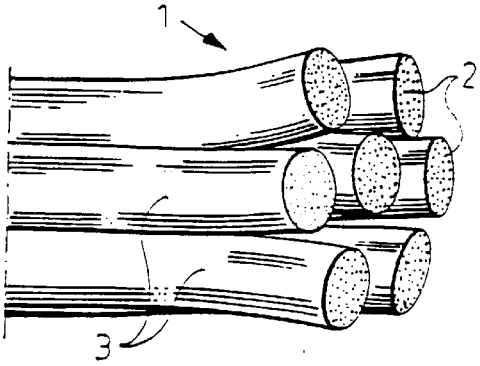
FIG. 2 shows the fibres of FIG. 1 after the step of ion bombardment, in which a diverging of emitting ends of the fibre segments has occurred.

Starting from, e.g., commercially available polyacrylnitryl carbon fibres, or other suited material containing carbon, the cathodes are formed by cutting mechanically the carbon fibres. With reference to FIGS. 1 and 2, a field emission cathode of the invention consists of a bundle 1 of carbon fibres 3 with emitting ends 2. In a bundle 1 there may be in the order of a hundred fibres 3 or more. The diameter of the fibres 3 are in the range of a few micrometers. For clarity, a small number only of the carbon fibre segments is shown in FIGS. 1 and 2.

Figure 3:
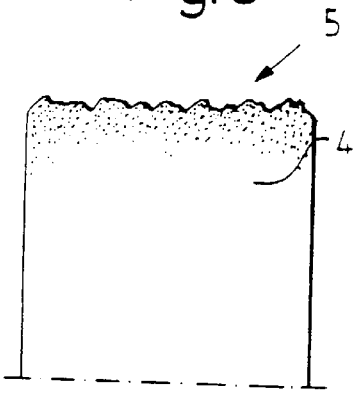
FIG. 3 shows schematically a possible "rough" profile of, generally, a surface to be prepared for emission in subsequent steps, and, specifically, an end surface of one fibre segment of FIG. 1.

In the first step in preparing, the cut fibre bundles are annealed, preferably in open air at a temperature which is increased continuously for about 1.5 hours to approximately 500° C. and then maintained for about 8–10 minutes. This treatment improves the ability of the emitting surface to develop effectively emitting irregularities. FIG. 1 shows a part only of the bundle 1 of fibres 3 with the emitting ends 2 after the annealing. FIG. 3 shows a profile 5 of one fibre 4 after the annealing, the emitting end profile 5 having small irregularities.

The next step of preparing the emitting ends is performed together with the step of modifying ("buring-in") in a vacuum chamber. The pressure in the chamber is approximately $10^{-6}$ Torr, which means that the chamber contains some residual gas. An electric field strong enough for election emission to occur from the emitting ends is applied to the cathode. The application of the electric field also causes ions of the residual gas to accelerate toward the emitting surface and collide with it creating new irregularities. As the electric field is increased, the emission will reach levels in the sharpest irregularities (peaks), causing them to melt locally. If the electric field strength is increased slowly, the melting will be restricted and a substantial portion of the irregularities be preserved, and so will the field emission properties of the emitting ends. Preferably, the electrical field is increased in five, possibly, equal steps from zero to full operating voltage, each step being a few minutes, e.g., ten minutes.

Figure 4:
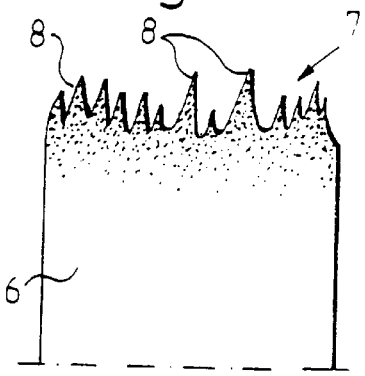
FIG. 4 shows schematically a possible "multi-pointed" profile of, generally, an emitting surface to be modified further for emission in a subsequent step, and, specifically, an end surface of one fibre segment of FIG. 2.
Figure 5:
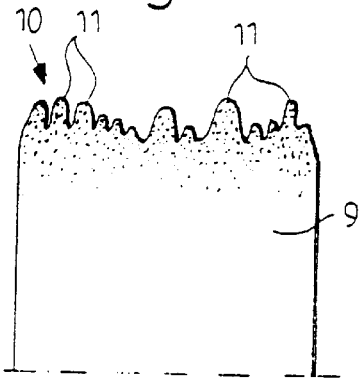
FIG. 5 shows schematically a possible "rounded off" profile of, generally, an emitting surface prepared and modified for emission, and, specifically, an end surface of one fibre segment of FIG. 2 after a step of modifying the ends of the fibre segments with a variable voltage.

FIG. 2 shows a part only of the bundle 1 of fibres 3 with the emitting ends 2 after the irradiation, wherein still another advantageous effect is achieved. The emitting ends 2 (the tips of the fibre segments) are slightly separated, which facilitates a wider distribution of emitted electrons. FIG. 4 shows a profile 7 of one fibre 6 after the irradiation, the emitting end profile 7 having high and sharp irregularities 8. FIG. 5 shows a profile 10 of one fibre 9 after the modifying, the emitting end profile 10 having high, but slightly rounded irregularities 11.

The step of irradiation (bombardment) of the emitting ends may be performed with ions of cesium or a similar low work function material. The ions are then saturated into the surface of the emitting ends, thereby lowering the electron work function of the emitting ends. Like the residual gas ions, these irradiation impacts also cause sharp irregularities in the emitting ends.

The step of modifying may be applied at different stages of the manufacturing of a field emission cathode according to the invention. For example, modifying may be performed when the fibres (or bodies) are being treated in the vacuum chamber and/or when they are mounted in an illuminating device or in any electron emitting device.

Figure 6:
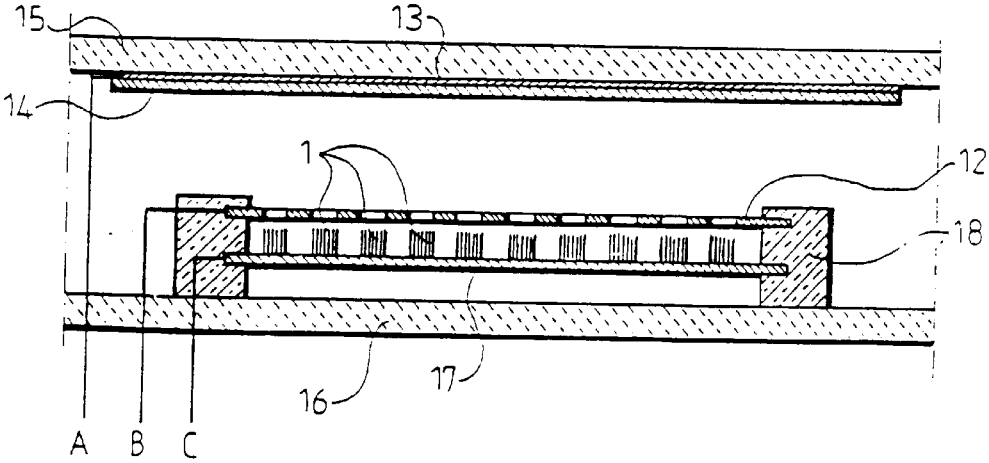
FIG. 6 shows field emission cathodes of the invention distributed in a matrix on a substrate in an illuminating device provided with a modulator grid electrode, an anode, and a fluorescent layer, operating inside an evacuated glass container.

FIG. 6 shows a light source with field emission cathodes applied in the form of bundles 1, preferably in a matrix, arranged on a conductive substrate 17. In the same plane as the matrix and in close proximity, in the order of tenths of millimetres, above the emitting ends of the bundles 1, there is provided a modulator electrode 12 with an aperture centred around each bundle. The substrate 17 and the modulator 12 rest on dielectric supports 18 inside an evacuated glass container with an upper boundary glass plate 15 and a lower boundary glass plate 16. Opposite the bundles 1 and the modulator, there is provided on the inside of the upper boundary 15 an anode 13 and a luminescent layer 14. The anode 13, the modulator 12, and the substrate 17, have electrical terminals A, B, C, respectively, for application of voltages leading electrons from the bundles 1, via the modulator apertures, to the luminescent layer 14 in connection with the anode 13. When electrons hit the the luminescent layer 14, light is emitted escaping the transparent anode 13 and the glass container.

We claim:

1. A method in the production of a field emission cathode constituted by at least one body containing a first substance, wherein said at least one body has at least one emitting surface with at least one irregularity, said method comprising the step of modifying said emitting surface by applying to said at least one body a variable electric field, in order to induce electron field emission from said emitting surface, and increasing said variable electric field, in such a manner that a deterioration of said at least one irregularity of said emitting surface is limited.

2. A method according to claim 1, said method further comprising a step of preparing said emitting surface, so as to improve its irregularities to facilitate electron field emission, by at lest one of the following:

a mechanical treatment of said at least one body;

an erosion treatment of said at least one body;

an irradiation treatment of said at least one body;

annealing in open air.

3. A method according to claim 1, wherein said variable electric field, in the step of modifying said emitting surface, is increased in steps with predetermined magnitudes and durations, from a low field strength to a field strength in the order of an operating voltage of said field emission cathode.

4. A method according to claim 1, comprising in combination the steps of preparing said emitting surface so as to improve its irregularities to facilitate electron field emission;

modifying said emitting surface according to said step of modifying.

5. A method according to claim 1, comprising in sequence the steps of preparing said emitting surface so as to improve its irregularities to facilitate electron field emission;

modifying said emitting surface according to said step of modifying.

6. A method according to claim 1, wherein the step of modifying is performed together with a step of preparing said emitting surface by an irradiation treatment of said at least one body in a vacuum environment containing residual gas, said variable electric field causing ions of the residual gas to be irradiated onto said emitting surface.

7. A method according to claim 1, wherein said field emission cathode is made from a material containing said first substance, said method further comprising the step of annealing at an elevated temperature said material in order to obtain at least one of the following:

a removal from said material of other substances than said first substance;

normalization of internal structure of said material;

normalization of surface structure of said material.

8. A method according to claim 1, said method further comprising the step of adding to said emitting surface a second substance with a lower work function than that of said first substance, in order to lower the electrical field strength required to induce electron field emission from said emitting surface.

9. A method according to claim 8, wherein the step of adding and a step of preparing said emitting surface by an irradiation treatment of said at least one body are combined into the step of irradiating said emitting surface with particles of said second substance.

10. A method according to claim 1, wherein said at least one body is a fibre segment and said emitting surface is an end surface of said fibre segment.

11. A method according to claim 10, wherein said cathodes are formed as bundles from a plurality of said fibre segments, and wherein any of the method steps is adapted for making said emitting ends of the bundled fibre segments diverge.

12. A field emission cathode, comprising at least one body of an electro-conductive first substance with at least one emitting surface having at least one irregularity adapted for continuous electron field emission through modification of said emitting surface by applying to said at least one body a variable electric field, in order to induce electron field emission from said emitting surface, and increasing said variable electric field, in such a manner that a deterioration of said at least one irregularity of said emitting surface is limited.

13. A field emission cathode according to claim 12, wherein the emitting surface contains a second substance with a work function lower than that of said first substance.

14. A field emission cathode according to claim 12, wherein said first substance is carbon.

15. A field emission cathode according to claim 13, wherein said second substance is cesium.

16. A field emission device comprising:

at least one field emission cathode, with at least one body of an electro-conductive first substance with at least one emitting surface, said emitting surface having at least one irregularity adapted for continuous electron field emission through modification of said emitting surface by applying to said at least one body a variable electric field, in order to induce electron field emission from said emitting surface, and increasing said variable electric field, in such a manner that a deterioration of said at least one irregularity of said emitting surface is limited;

modulator means arranged separated from said at least one field emission cathode;

anode means;

target means;

an evacuated chamber;

said field emission cathode, said modulator means, said anode means and said target means being substantially enclosed in said evacuated chamber;

said field emission cathode, said modulator means, and said anode being connected to a first, a second, and a third voltage potential, respectively, and being arranged geometrically so as to induce field emission of electrons from said field emission cathode onto said target means.

17. A field emission device according to claim 16, wherein said target means is luminescent;

said evacuated chamber is light transparent;

electrons are emitted onto said luminescent target means causing it to emit light externally of said evacuated chamber.

18. A field emission device according to claim 16, wherein said emitting surface contains a second substance with a work function lower than that of said first substance.

19. A method according to claim 1, wherein a step of performing said step of modifying for modifying at least one emitting surface with said at least one irregularity to have a radius of curvature being in the range 0.1–100 nanometers.

20. A field emission cathode according to claim 12, wherein said at least one irregularity has a radius of curvature being in the range 0.1–100 nanometers.

21. A field emission device according to claim 16, wherein said at least one irregularity has a radius of curvature being in the range 0.1–100 nanometers.

* * * * *